US009060571B2

(12) United States Patent
Hykamp

(10) Patent No.: US 9,060,571 B2
(45) Date of Patent: Jun. 23, 2015

(54) COMBINED FASHION ACCESSORY AND KEY

(71) Applicant: DB Imports Inc., Toronto (CA)

(72) Inventor: Mikael Alexander Hykamp, Toronto (CA)

(73) Assignee: DB Imports Inc., Toronto (CA)

( * ) Notice: Subject to any disclaimer, the term of this patent is extended or adjusted under 35 U.S.C. 154(b) by 0 days.

(21) Appl. No.: 14/379,076

(22) PCT Filed: Feb. 28, 2013

(86) PCT No.: PCT/CA2013/050147
§ 371 (c)(1),
(2) Date: Aug. 15, 2014

(87) PCT Pub. No.: WO2013/159212
PCT Pub. Date: Oct. 31, 2013

(65) Prior Publication Data

US 2015/0007625 A1 Jan. 8, 2015

Related U.S. Application Data

(60) Provisional application No. 61/637,951, filed on Apr. 25, 2012.

(51) Int. Cl.
*E05B 19/08* (2006.01)
*A44B 5/00* (2006.01)
(Continued)

(52) U.S. Cl.
CPC . *A44B 5/002* (2013.01); *A44B 5/02* (2013.01); *E05B 19/00* (2013.01)

(58) Field of Classification Search
CPC ..... A44B 5/002; A44C 13/00; A45C 11/324; G07C 9/00944; E05B 19/00; E05B 19/04; E05B 19/043; E05B 35/004; E05B 35/005
USPC ..... 70/16, 403, 404, 408, 456 R, 459, 460, 70/395–397, 399, 400, 409; 24/3.6; 206/38.1, 37.1–37.8
See application file for complete search history.

(56) References Cited

U.S. PATENT DOCUMENTS 384,592 A * 6/1888 Ross ..... 7/138
1,904,354 A * 4/1933 Buxton ..... 206/37.7
(Continued)

OTHER PUBLICATIONS

Search Report and Written Opinion for International Patent Application No. PCT/CA2013/050147, mailed May 28, 2013, 6 pages.

*Primary Examiner* — Lloyd Gall
(74) *Attorney, Agent, or Firm* — Fiala & Weaver P.L.L.C.

(57) ABSTRACT

This invention provides a combined fashion accessory and key. The fashion accessory includes a decorative head having front and back sides, an elongate shaft having first and second opposed ends. The first end of the elongate shaft is attached to the back side of the decorative head, and an elongate bar is pivotally connected to the second end of the elongate shaft. The elongate bar has at least one key feature at a first end thereof so that the elongate bar is a key. When the elongate bar is longitudinally aligned with said elongate shaft in a second locking position, the decorative head, in combination with the elongate shaft and the elongate bar provides a key functionality such that when the key feature is inserted into a lock and a user grips a grippable peripheral portion of the decorative head and rotates it, torque is applied to the elongate bar thus rotating it and the key feature to unlock the lock.

8 Claims, 3 Drawing Sheets

(51) Int. Cl.
*A44B 5/02* (2006.01)
*E05B 19/00* (2006.01)

(56) References Cited

U.S. PATENT DOCUMENTS

| | | | | | |
|---|---|---|---|---|---|
| 2,231,308 | A | * | 2/1941 | Walsh et al. | 24/3.6 |
| 2,326,693 | A | * | 8/1943 | Sindler | 70/457 |
| 2,453,190 | A | * | 11/1948 | Boscowitz | 63/1.12 |
| 2,665,465 | A | | 1/1954 | Albrecht | |
| 3,267,534 | A | * | 8/1966 | Dansereau | 24/3.1 |
| 4,637,238 | A | * | 1/1987 | Uda et al. | 70/456 R |
| 5,046,343 | A | * | 9/1991 | Miwa | 70/408 |
| 5,058,465 | A | * | 10/1991 | Womack | 81/487 |
| 5,085,063 | A | * | 2/1992 | Van Dyke et al. | 70/218 |
| 5,421,180 | A | * | 6/1995 | Rojdev | 70/456 R |
| 5,440,909 | A | * | 8/1995 | Ely et al. | 70/395 |
| 5,595,080 | A | * | 1/1997 | Whinton | 70/432 |
| 5,638,713 | A | * | 6/1997 | Roth et al. | 70/404 |
| 5,937,680 | A | | 8/1999 | Parsons | |
| 6,035,679 | A | * | 3/2000 | Meroni | 70/396 |
| 6,109,073 | A | * | 8/2000 | Parsons | 70/16 |
| 6,164,102 | A | * | 12/2000 | Gapco | 70/408 |
| 6,189,347 | B1 | * | 2/2001 | Thompson | 70/16 |
| 6,233,987 | B1 | * | 5/2001 | Ueno et al. | 70/408 |
| 6,609,811 | B1 | * | 8/2003 | Sharrah | 362/116 |
| 6,874,342 | B1 | * | 4/2005 | Batista | 70/456 R |
| 8,667,822 | B1 | * | 3/2014 | Jaffe et al. | 70/395 |
| 8,776,563 | B1 | * | 7/2014 | Jaffe et al. | 70/456 R |
| 2014/0007618 | A1 | * | 1/2014 | Brown, III | 63/1.18 |

* cited by examiner

COMBINED FASHION ACCESSORY AND KEY

CROSS-REFERENCE TO RELATED APPLICATIONS

This application is a National Phase application claiming the benefit of No. PCT/CA2013/050147 filed on Feb. 28, 2013, in English, which further claims priority to U.S. Provisional Application No. 61/637,951, entitled "COMBINED CUFFLINK AND HANDCUFF KEY" filed on Apr. 25, 2012, the entire contents of which are incorporated herein by reference.

FIELD OF THE INVENTION

This invention relates to a combined fashion accessory and key.

BACKGROUND

A cufflink is a fashion accessory which allows the sleeve of a shirt to be closed when the shirt has only button holes in the cuffs instead of buttons. Most known cuff links include a decorative head part an elongate shaft part and at the other end a clasp part in the form of an elongate bar that pivots from a position aligned with the elongate shaft so as to be able to insert the aligned elongate shaft and the elongate bar through the button holes, to a position orthogonal to the elongate shaft to anchor the accessory to the sleeve.

SUMMARY

Disclosed herein is a combined fashion accessory and key for unlocking locks. In one embodiment, the combined fashion accessory and key is a cufflink having a key functionality. The cufflink comprises a decorative head having front and back sides and a grippable peripheral portion, and includes an elongate shaft having first and second opposed ends with the first end of the elongate shaft being attached to the back side of the decorative head. An elongate bar pivotally is connected to the elongate shaft adjacent to the second end of the shaft. Included is a locking mechanism and the elongate bar is pivotally movable between a first locking position in which the elongate bar is longitudinally aligned with the elongate shaft and a second locking position in which the elongate bar is substantially perpendicular to the elongate shaft. The elongate bar has at least one key feature located at a distal end thereof. When the elongate bar is longitudinally aligned with the elongate shaft in the first locking position, the decorative head, in combination with the elongate shaft and the elongate bar provides a key functionality such that when the key feature is inserted into a lock and a user grips the grippable peripheral portion of the decorative head and rotates the decorative head, torque is applied to the elongate bar thus rotating it and the key feature to unlock the lock.

A further understanding of the functional and advantageous aspects of the invention can be realized by reference to the following detailed description.

BRIEF DESCRIPTION OF DRAWINGS

The following is a description a combined cufflink/handcuff key constructed in accordance with the present invention, reference being had to the accompanying drawings, in which.

DETAILED DESCRIPTION

Generally speaking, the embodiments described herein are directed to a combined fashion accessory and key. As required, embodiments of the present invention are disclosed herein. However, the disclosed embodiments are merely exemplary, and it should be understood that the invention may be embodied in many various and alternative forms. Thus, for purposes of teaching and not limitation, the illustrated embodiments are directed to a combined fashion accessory and key.

Various embodiments and aspects of the disclosure will be described with reference to details discussed below. The following description and drawings are illustrative of the disclosure and are not to be construed as limiting the disclosure. The drawings are not to scale. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in this specification including claims, the terms, "comprises" and "comprising" and variations thereof mean the specified features, steps or components are included. These terms are not to be interpreted to exclude the presence of other features, steps or components.

As used herein, the terms "example", "exemplary" means "serving as an example, instance, or illustration," and should not be construed as preferred or advantageous over other configurations disclosed herein.

As used herein, the terms "about" and "approximately", when used in conjunction with ranges of dimensions of particles, compositions of mixtures or other physical properties or characteristics, are meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present disclosure.

As used herein the expression cufflink refers to cufflinks as worn on shirt sleeves having a decorative head but can also mean decorative buttons or fashion accessories affixed to clothing in other places besides the sleeves of a shirt.

The present invention relates to a fashion accessory which provides a partially concealed key which is not readily identifiable as a key but is easily activated and usable as a key. The key is camouflaged and concealed in a variety of positions on a garment button such as the operable clasp of a cuff link. In an embodiment the fashion accessory is a cufflink which allows the sleeve of a shirt to be closed when it has only bottom holes in the cuff of the shirt.

Figure 1:
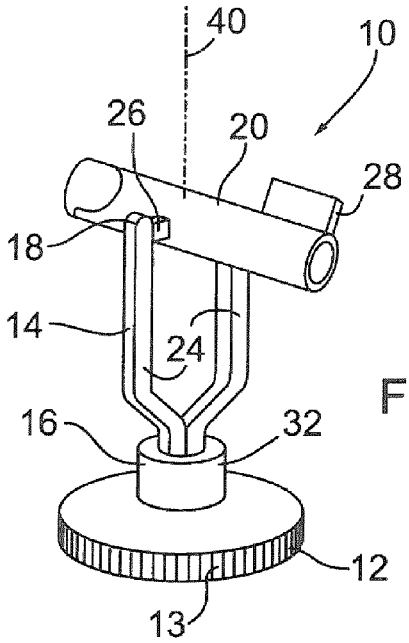
FIG. 1 is a perspective view of a combined fashion accessory and key configured to be used as a cuff link inserted into a cuff of a shirt.
Figure 2:
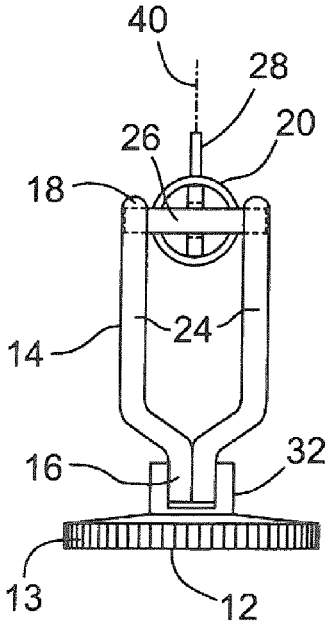
FIG. 2 is an elevational view of the combined cufflink and handcuff key of FIG. 1.
Figure 3:
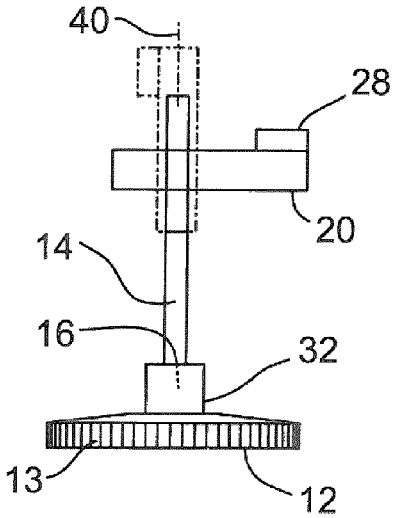
FIG. 3 is another elevational view of the combined fashion accessory and key key with the solid lines the same as FIG. 1 but and the broken lines showing the bar rotated 90 degrees in position to be used as a key for unlocking a lock.

Referring to FIGS. 1 to 3, an embodiment of a combined fashion accessory/key shown generally at 10 includes a decorative head section 12 having front and back surfaces and a grippable peripheral edge 13, an elongate shaft section 14 attached at one end 16 to the back of the decorative head section 12 and at the other end 18 of the elongate shaft section 14 there is a pivotally attached clasp section 20 in the form of an elongate arm or bar that pivots from a first locking position in which the elongate bar 20 is aligned with shaft 14 (shown in broken lines in FIG. 3) to a second locking position in which elongate bar 20 is orthogonal to the elongate shaft 14 as shown in solid lines in FIGS. 1 to 3. While FIGS. 1 to 3 show a disc shaped decorative head with a knurled peripheral edge 13 for griping, it will be appreciated other shapes can be used, for example square heads may be used which since they are square are inherently grippable and thus a knurled peripheral outer edge is not necessary.

When fashion accessory/key 10 is being used as a fashion accessory and affixed to clothing, the elongate bar 20 in the combined fashion accessory/key 10 is rotated into the first locking position in which elongate bar 20 is aligned with elongate shaft 14 along longitudinal axis 40 of the shaft 14 (see FIGS. 1 to 3) in order to allow the aligned elongate bar 20 and elongate shaft 14 to be inserted through the two aligned button holes in a shirt sleeve when used as a cufflink, (or any other aperture in clothing to which it is being affixed when being used as a brooch for example) after which the elongate bar 20 is pivoted perpendicular to axis 40 into the second locking position to attach the fashion accessory to the garment, just as with a standard cufflink when accessory 10 is being used as a cufflink.

Elongate bar section 20 includes a key feature 28 located at a distal end thereof used for unlocking a handcuff lock. When the lock being unlocked is that of a set of handcuffs, elongate bar 20 is hollow, particularly at the distal end containing the key feature 28, in order to be able to engage the handcuff lock. In operation to be used as a key, the elongate bar 20 in the combined fashion accessory/key 10 is rotated into the first locking position in which elongate bar 20 is aligned with elongate shaft 14 along longitudinal axis 40 of the pin (see FIGS. 1 to 3) in order to allow the aligned elongate bar 20 and elongate shaft 14 to be inserted into the lock of the pair of handcuffs. When the elongate bar 20 is longitudinally aligned with the elongate shaft 14 in the first locking position, the decorative head 12, in combination with the elongate shaft 14 and elongate bar 20 provides a key functionality such that when the key feature is inserted into a lock and a user grips the grippable peripheral portion 13 of the decorative head 12 and rotates the decorative head, torque is applied to the elongate bar 20 thus rotating it and the key feature to unlock the lock.

Thus, in addition to the normal functionality of the present fashion accessory 10 as a cufflink or other accessory, elongate bar 20 being configured as a key allows the accessory 10 to be used as a key for unlocking certain kinds of locks such as handcuffs. This is achieved by the user is able gripping the grippable portion 13 of the decorative head 12 and rotating the "key" portion 20 of the cufflink. In other words the decorative head portion 12 is the handle of the key 20 and cooperates with the "key feature" portion 28 to unlock the handcuffs.

In an embodiment, the elongate bar 20 in the present cufflink has a size, shape and profile of a handcuff key so that it operates in all respects as does a standard handcuff key, but includes the feature of being concealed to a garment button. It will be understood that the present invention is not limited to "standard handcuff keys" but includes any type of handcuff key. There are various different handcuff producers and they all have their own specific handcuff keys and the present invention covers any type of handcuff key.

Many handcuff keys have a locking pin (not shown) which is an elongated probe attached to a handcuff key. In many typical applications handcuffs are double locked to prevent picking or shimming. This is done through the use of the locking pin which sets the double lock mechanism on handcuffs after which the hand cuffs can no longer be tightened. The locking pin may be a cylindrical extension from the end of elongate bar 20 that is opposed to the distal end on which the key feature 28 is located. The double lock mechanism increases the security of handcuff restraining devices. It will be understood that the locking pin does not need to be included as part of the present key 10, and is optional. In another embodiment the locking pin may be replaced with a second key feature 28 on pivoting elongate bar 20 so bar 20 has a key feature 28 on each opposing end to allow access to a handcuff key when the elongate bar 20 is pivoted in either direction. The elongate bar 20 is pivotally movable 360 degrees with respect to the elongate shaft 14 and has multiple locking positions, typically four as there are four pairs of opposed flat surfaces on cross bar 26 against which springs arms 56 can bear.

An embodiment of the elongate shaft 14 includes a generally U-shaped bracket including pair of spaced arms 24 with the ends 16 contained in a collar 32 which is attached to the back surface of head section 12 and, as shown in FIGS. 1 to 3. A cross bar 26 extends between the opposed ends 18 of spaced arms 24 (FIG. 2) and passes through holes in the ends 18 of the arms, shown in broken lines in FIG. 2. Cross bar 26 has a rectangular or square cross section.

Figure 5:
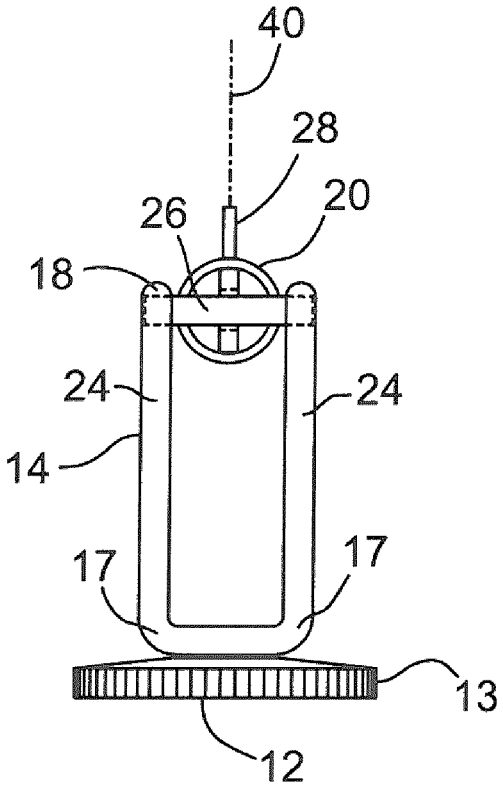
FIG. 5 shows an alternative embodiment of the combined fashion accessory and key.

Another embodiment shown in FIG. 5 includes a U-shaped elongate shaft 14 having the arms 24 depending from a shoulder section 17 that is rigidly affixed to the back surface of decorative head 12, so that collar 32 is not required.

It will be appreciated that other shapes of connectors connecting the bar 20 and the decorative head 12 may be used. An alternative embodiment to that shown in FIGS. 1 to 3 may have as the shaft section 14 being only a single arm which may itself be the handcuff key rather than the pivoting bar 20. In this embodiment there may be a quick release to remove the bar 20 from arm 14 to allow the key to be used. Alternatively, the elongate bar 20 and elongate arm 14 may be configured such that arm 14 is a single arm and when the bar 20 is aligned with arm 14, the aligned configuration can function as the key, with the bar 20 and arm 14 having features allowing them to be rigidized together when the combination is used as the key.

Figure 4B:
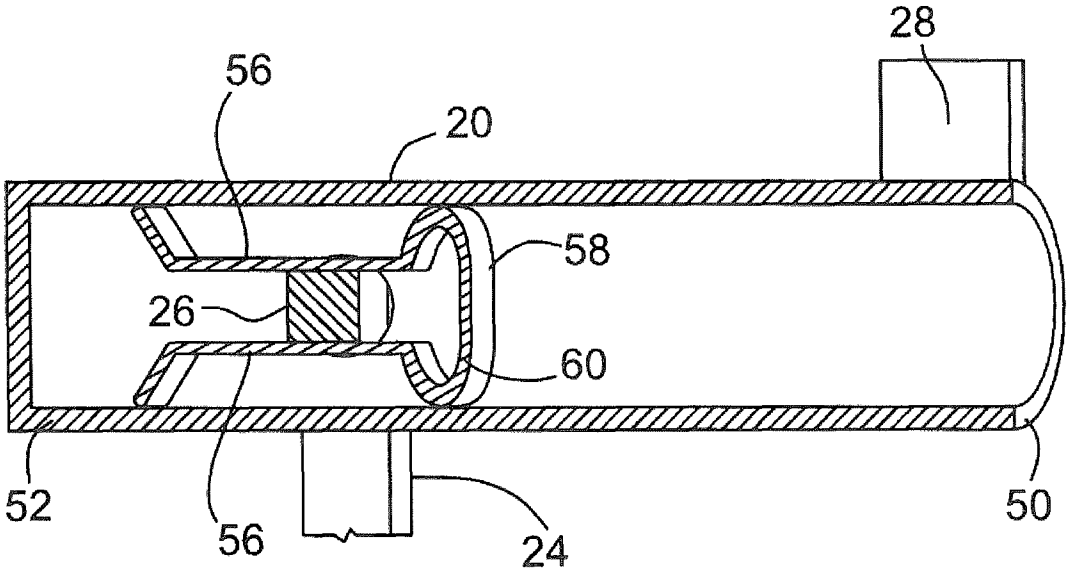
FIG. 4*b* shows a cross sectional view showing the interior of a rotatable bar portion of the combined fashion accessory and key forming a locking mechanism for locking the rotatable bar in one position where the combined device is a cufflink and in a second position perpendicular to the first position configured to be used as a key.
Figure 4A:
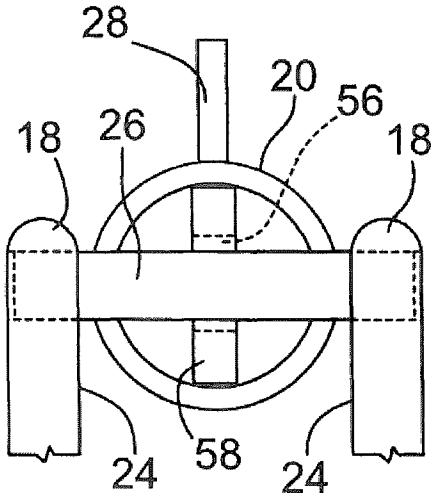
FIG. 4*a* shows an end view of a portion of the combined fashion accessory and key.

When configured for use as a key for unlocking handcuffs, elongate bar 20 is a hollow cylinder and contained therein is a locking mechanism for locking elongate bar 20 in the first and second positions. Referring to FIGS. 4*a* and 4*b*, the interior of cylinder 20 is hollow and open at end 50 providing space for the guiding pin located in the handcuff lock to access the interior of elongate bar 20. This same end 50 also has the key function or feature 28 attached thereto. The combination of the hollow cylinder 20 and feature 28 provides a key that allows the cylinder 20 to enter the handcuff lock and freely turn thus opening the handcuff. Located in the opposed end 52 of cylinder 20 is a spring 60 that allows for the cylinder 20 to be locked in the first or second positions. Spring 60 has a shoulder section 58 and a pair of arms 56 with each arm extending from an associated side of shoulder section 58. The ends of arms 56 distal from shoulder section 58 bear against the inner wall of cylinder 20, the shoulder section 58 has opposed sides that also bear against the inner wall of cylinder 20, and each arm 56 has a flexible midsection spaced inwardly from inner wall of cylinder 20. The present design uses a short spring 60 so that space is provided for the handcuff guiding pin (located in the handcuff) to enter the elongate cylinder 20.

The cross section of cross bar 26 located inside cylinder 20 is square so that the opposed flexible midsections of the two arms 56 can lock onto opposed flat sides of cross bar 26. Spring 60 is used to lock the elongate cylinder 20 in the first and second positions. When in either the first or second position, the flexible midsections of the two spring arms 56 press on the opposed flat sides of cross bar 26 passing through the elongate cylinder 20. The two ends of cross bar 26 are rigidly attached to associated ends of arms 14 and does not rotate with respect to arms 14. When the user applies force on one end of cylinder 20 to pivot or rotate it, the cylinder 20 pivots with respect to cross bar 26 between the first and second perpendicular positions with the opposed corners of cross bar 26 pushing out the flexible midsections of arms 56 towards the inner wall of cylinder 20. Spring 60 is strong enough so that once in either the first or second locking positions, it locks the cylinder 20 in that position so that the cylinder 20 does not freely rotate. In one of the positions the cylinder 20 is parallel to and aligned between the two arm sections 14 such that in this position the device is used as a key for unlocking handcuffs and for being inserted through holes in the sleeves of a shirt when being attached to the cuff of a shirt sleeve for use as a cuff link. Once inserted through the button holes in the shirt cuff the cylinder 20 is rotated 90 degrees to the other locking position such that cylinder 20 is perpendicular to arm sections 14 thus retaining it in the cuff of the shirt.

In another embodiment the handcuff key portion 20 may be attached to the decorative head 12 of the cuff link 10 with a ring, chain or other flexible attachment.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims and their equivalents.

Therefore, what is claimed is:

1. A cufflink having a key functionality, comprising:

a decorative head having front and back sides and a grippable peripheral portion;

an elongate shaft having first and second opposed ends, said first end of said elongate shaft being attached to said back side of said decorative head;

an elongate bar pivotally connected to said elongate shaft adjacent to said second end, a locking mechanism, said elongate bar being pivotally movable between a first locking position in which said elongate bar is longitudinally aligned with said elongate shaft and a second locking position in which said elongate bar is substantially perpendicular to said elongate shaft, said elongate bar having at least one key feature at a distal end thereof; and wherein when said elongate bar is longitudinally aligned with said elongate shaft in said first locking position, said decorative head, in combination with said elongate shaft and said elongate bar provides a key functionality such that when said at least one key feature is inserted into a lock and a user grips said grippable peripheral portion of said decorative head and rotates said decorative head, torque is applied to said elongate bar thus rotating it and said at least one key feature to unlock the lock.

2. The cufflink according to claim 1 wherein said elongate bar is hollow cylinder, and wherein said distal end of said hollow cylinder and said at least one key feature are configured to engage and unlock handcuffs.

3. The cufflink according to claim 2, wherein said elongate shaft includes two spaced arm sections and a cross bar at the second end connecting the two spaced arm sections, said hollow cylinder having a hole through a central portion thereof, and the cross bar extending through said hole and the hollow cylinder being pivotally movable about said cross bar.

4. The cufflink according to claim 3, wherein said cross bar has a generally rectangular cross section, and wherein said hollow cylinder includes a spring having a pair of spaced arm sections each having an end section that bears against an inner surface of said hollow cylinder and a flexible middle section spaced from said inner surface, said cross bar extending between said pair of spaced arm sections through said hole such that said each of said spaced arm sections bear down on opposed sides of said cross bar, and wherein in said first locking position of said hollow cylinder said middle sections bear against first opposed sides of said cross bar, and pivoting said hollow cylinder about said cross bar to said second locking position causes opposed corners of the cross bar to bear against the middle sections of the arm sections moving them towards the inner surface until the cross bar has rotated 90 degrees at which point said middle sections bear against second opposed sides of said cross bar thereby locking said hollow cylinder in said second locking position.

5. The cufflink according to claim 1, including a second key feature mounted on a proximal end of said elongate bar, and wherein said elongate bar is pivotally movable 360 degrees with respect to said elongate shaft.

6. The cufflink according to claim 2, including a second key feature mounted on a proximal end of said elongate bar, and wherein said elongate bar is pivotally movable 360 degrees with respect to said elongate shaft.

7. The cufflink according to claim 3, including a second key feature mounted on a proximal end of said elongate bar, and wherein said elongate bar is pivotally movable 360 degrees with respect to said elongate shaft.

8. The cufflink according to claim 4, including a second key feature mounted on a proximal end of said elongate bar, and wherein said elongate bar is pivotally movable 360 degrees with respect to said elongate shaft.

* * * * *